US011505921B2

(12) United States Patent
Hyodo et al.

(10) Patent No.: US 11,505,921 B2
(45) Date of Patent: Nov. 22, 2022

(54) WHEEL LOADER

(71) Applicant: Hitachi Construction Machinery Co., Ltd., Tokyo (JP)

(72) Inventors: Koji Hyodo, Kasumigaura (JP); Isamu Aoki, Tsukuba (JP); Tetsuji Tanaka, Abiko (JP); Koji Shimazaki, Akashi (JP); Hironao Suzuki, Ushiku (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 365 days.

(21) Appl. No.: 16/641,735

(22) PCT Filed: Sep. 4, 2018

(86) PCT No.: PCT/JP2018/032783
§ 371 (c)(1),
(2) Date: Feb. 25, 2020

(87) PCT Pub. No.: WO2019/065122
PCT Pub. Date: Apr. 4, 2019

(65) Prior Publication Data

US 2020/0248436 A1 Aug. 6, 2020

(30) Foreign Application Priority Data

Sep. 29, 2017 (JP) ..... JP2017-191655

(51) Int. Cl.
*E02F 3/00* (2006.01)
*E02F 9/22* (2006.01)
(Continued)

(52) U.S. Cl.
CPC ..... *E02F 9/2253* (2013.01); *E02F 3/283* (2013.01); *E02F 3/422* (2013.01); *E02F 3/431* (2013.01);
(Continued)

(58) Field of Classification Search
CPC . E02F 3/283; E02F 3/422; E02F 3/431; E02F 3/434; E02F 9/2029; E02F 9/2066;
(Continued)

(56) References Cited

U.S. PATENT DOCUMENTS

2010/0131158 A1 5/2010 Saito
2012/0010790 A1 1/2012 Kanayama et al.
(Continued)

FOREIGN PATENT DOCUMENTS

EP 3 093 397 A1 11/2016
JP 2010-25179 A 2/2010
(Continued)

OTHER PUBLICATIONS

English Translation of WO2015068545A1 Abstract (See WO2015068545A1_Abstract_English.pdf) using the WIPO IP Portal via Patentscope (Year: 2015).*
(Continued)

*Primary Examiner* — James M McPherson
(74) *Attorney, Agent, or Firm* — Crowell & Moring LLP

(57) ABSTRACT

A wheel loader configured to reduce the traveling distance required for a raise and run operation, and reduce fuel consumption includes: an engine 3; a torque converter 41; a forward and reverse switch 62; a stepping amount sensor 610; an operation amount sensor 73; and a controller 5. The controller 5 determines whether a specific condition for specifying an operation of the lift arm 21 in an upper direction during forward travel of the vehicle body, on the basis of a forward and reverse switching signal, the stepping amount on the accelerator pedal 61, and a pilot pressure Ti pertaining to the lifting operation amount for the lift arm 21. When the specific condition is satisfied, the vehicle speed is limited by reducing the maximum rotational speed of the engine 3 in response to increase in the pilot pressure Ti.

6 Claims, 15 Drawing Sheets

(51) Int. Cl.

| | |
|---|---|
| ***E02F 3/28*** | (2006.01) |
| ***E02F 3/42*** | (2006.01) |
| ***E02F 3/43*** | (2006.01) |
| ***E02F 9/20*** | (2006.01) |

(52) U.S. Cl.
CPC ..... *E02F 9/2066* (2013.01); *E02F 9/2221* (2013.01); *E02F 9/2246* (2013.01)

(58) Field of Classification Search
CPC ..... E02F 9/2221; E02F 9/2246; E02F 9/2253; E02F 9/2296; F04B 1/295; F04B 17/05
See application file for complete search history.

(56) References Cited

U.S. PATENT DOCUMENTS

| | | | | |
|---|---|---|---|---|
| 2013/0259619 | A1 | 10/2013 | Shirao | |
| 2014/0207346 | A1 | 7/2014 | Filla et al. | |
| 2016/0326720 | A1* | 11/2016 | Uno | E02F 3/431 |
| 2019/0010679 | A1 | 1/2019 | Takeda et al. | |

FOREIGN PATENT DOCUMENTS

| | | | | | |
|---|---|---|---|---|---|
| JP | 2012-251557 | A | | 12/2012 | |
| JP | WO2015068545 | A1 | * | 10/2014 | E02F 9/2253 |
| JP | 2015-86575 | A | | 5/2015 | |
| JP | 2017-166587 | A | | 9/2017 | |
| WO | WO 2009/019974 | A1 | | 2/2009 | |
| WO | WO 2010/110086 | A1 | | 9/2010 | |
| WO | WO 2013/145342 | A1 | | 10/2013 | |
| WO | WO 2015/068545 | A1 | | 5/2015 | |

OTHER PUBLICATIONS

English Translation of WO2015068545A1 Specification (See WO2015068545A1_Specification_English.pdf) using the WIPO IP Portal via Patentscope (Year: 2015).*

International Search Report (PCT/ISA/210) issued in PCT Application No. PCT/JP2018/032783 dated Nov. 20, 2018 with English translation (five (5) pages).

Japanese-language Written Opinion (PCT/ISA/237) issued in PCT Application No. PCT/JP2018/032783 dated Nov. 20, 2018 (five (5) pages).

* cited by examiner

WHEEL LOADER

TECHNICAL FIELD

The present invention relates to a wheel loader.

BACKGROUND ART

As a travel drive system of a wheel loader, a torque converter type travel drive system that transmits the drive force of an engine to wheels via a torque converter, has been known. In the wheel loader equipped with the torque converter type travel drive system, the rotational speed of an engine is changed based on the ratio of the rotational speed of an input shaft of a torque converter and the rotational speed of an output shaft (=output rotational speed/input rotational speed), and the rotation with the changed rate is transmitted to wheels.

For example, Patent Literature 1 discloses a wheel loader that includes: a travel drive device that transmits the rotation of an engine to tires via a torque converter and a transmission; a front working device that includes a lift arm rotatable in the vertical direction; a variable displacement hydraulic pump that is driven by the engine to supply pressurized oil to an actuator for driving the front working device; and a controller that controls each element of a vehicle body.

This wheel loader limits the maximum absorption torque of the hydraulic pump with respect to the actual rotational speed of the engine in a low speed range when the stepping amount of an accelerator pedal is smaller than a predetermined value, and limits the maximum absorption torque in the low speed range and a medium speed range when the stepping amount of the accelerator pedal is larger than the predetermined value, which increases the rate of increase in the actual rotational speed of the engine, and improves the blow-up performance of the engine.

CITATION LIST

Patent Literature

Patent Literature 1: Japanese Patent Laid-Open No. 2015-86575

SUMMARY OF INVENTION

Technical Problem

Unfortunately, in the wheel loader described in Patent Literature 1, the rate of increase in the actual rotational speed of the engine is high even in what is called a raise and run operation of moving a lift arm in the upper direction during forward travel of the vehicle body. Consequently, increase in the travel speed of the vehicle body is enhanced, and the lift arm lifting speed becomes relatively low with respect to the traveling speed. Accordingly, complete rise of the lift arm in the upper direction requires a certain time period. Consequently, it is required to set a long traveling distance required for the raise and run operation. Furthermore, increase in the traveling distance, in turn, increases the fuel consumption of the wheel loader.

Accordingly, the present invention has an object to provide a wheel loader that can reduce the traveling distance required for the raise and run operation, and reduce fuel consumption.

Solution to Problem

To achieve the object described above, a wheel loader is provided that includes a front working device including a lift arm rotatable in a vertical direction, the front working device being provided at a front of a vehicle body, the wheel loader traveling by transmitting a drive force of an engine to wheels via a torque converter, and further including: a traveling state sensor that detects a traveling state of the vehicle body; a motion sensor that detects that the lift arm is in a lifting motion; and a controller that controls the engine, wherein the controller determines whether a specific condition for specifying an operation of the lift arm in an upper direction during forward travel of the vehicle body is satisfied or not, based on the traveling state detected by the traveling state sensor, and on a state of a lifting motion of the lift arm detected by the motion sensor, and limits a vehicle speed by reducing a maximum rotational speed of the engine in a case of satisfying the specific condition.

Advantageous Effects of Invention

The present invention can reduce the traveling distance required for a raise and run operation, and reduce fuel consumption. Problems, configurations and advantageous effects other than those described above are clarified by the following description of embodiments.

DESCRIPTION OF EMBODIMENTS

The entire configuration and operations of a wheel loader according to each embodiment of the present invention are described with reference to FIGS. 1 to 3.

Figure 1:
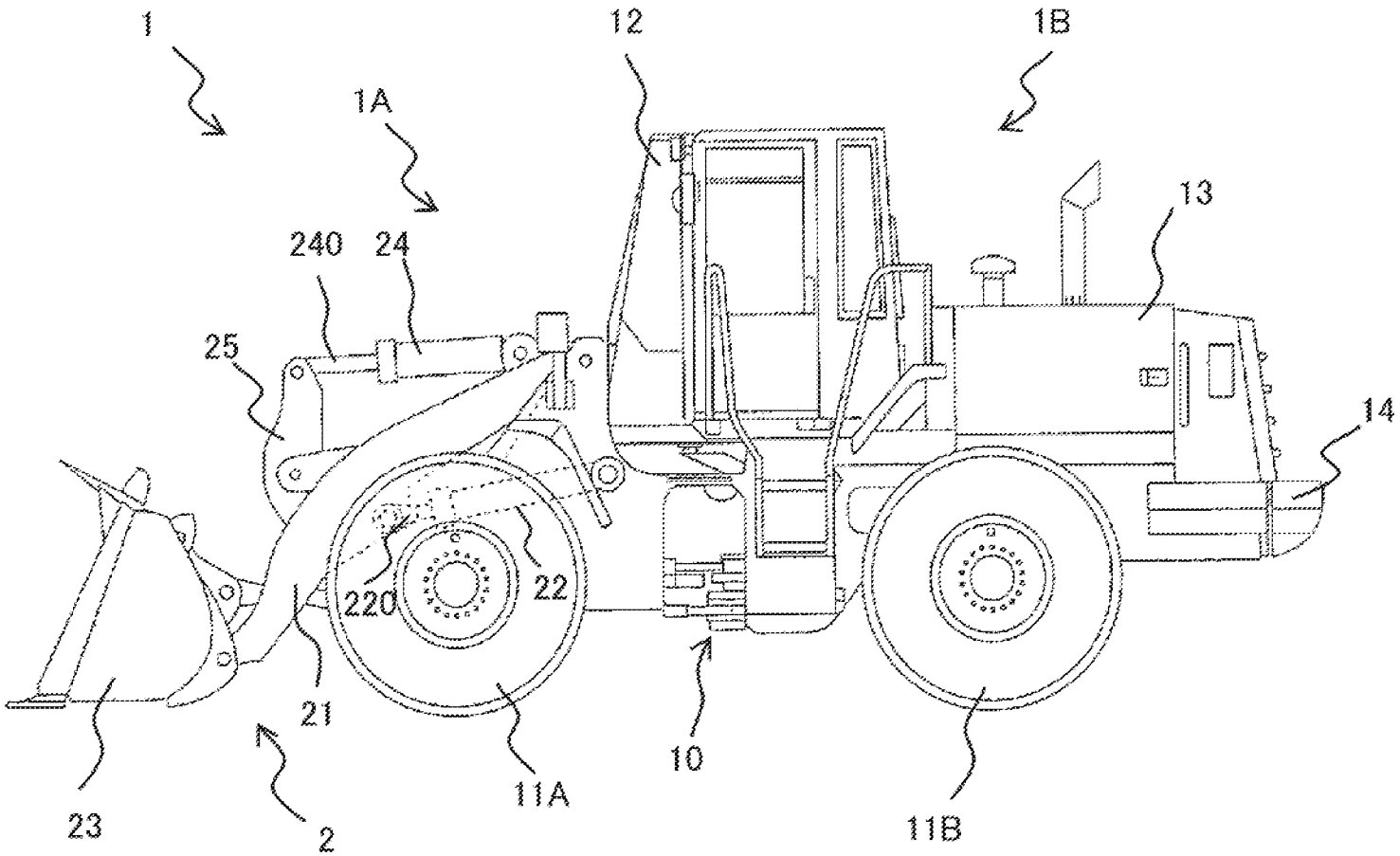
FIG. 1 is a side view showing an appearance of a wheel loader according to each embodiment of the present invention.

FIG. 1 is a side view showing an appearance of the wheel loader 1 according to each embodiment of the present invention.

The wheel loader 1 includes: a vehicle body that includes a front frame 1A and a rear frame 1B; and a front working device 2 provided at the front of the vehicle body. The wheel loader 1 is an articulate working machine that is steered by bending the vehicle body around the center. The front frame 1A and the rear frame 1B are joined by a center joint 10 so as to be freely rotatable in the lateral direction. The front frame 1A is bent in the lateral direction with respect to the rear frame 1B.

The front frame 1A is provided with a pair of left and right front wheels 11A, and the front working device 2. The rear frame 1B includes a pair of left and right rear wheels 11B, an operating room 12 where an operator boards, a machine room 13 that accommodates various devices, such as an engine, a controller and a cooler, and a counter weight 14 for keeping the balance so as to prevent the vehicle body from inclining or rolling over. Note that FIG. 1 shows only the left front wheel 11A and rear wheel 11B among the pairs of left and right front wheels 11A and rear wheels 11B.

The front working device 2 includes: a lift arm 21 rotatable in the vertical direction; a pair of lift arm cylinders 22 that are extended and retracted to thereby drive the lift arm 21; a bucket 23 attached to the distal end of the lift arm 21; a bucket cylinder 24 that is extended and retracted to thereby rotate the bucket 23 in the vertical direction with respect to the lift arm 21; a bellcrank 25 rotatably joined to the lift arm 21 to constitute a link mechanism between the bucket 23 and the bucket cylinder 24; and a plurality of pipes (not shown) that guide pressurized oil to the pair of lift arm cylinders 22 and the bucket cylinder 24. Note that FIG. 1 shows, with broken lines, only the lift arm cylinder 22 arranged to the left between the pair of the lift arm cylinders 22.

The lift arm 21 is rotated in the upper direction by extending rods 220 of the respective lift arm cylinders 22, and is rotated in the lower direction by retracting the rods 220. The bucket 23 is rotated (tilted) in the upper direction with respect to the lift arm 21 by extending a rod 240 of the bucket cylinder 24, and is rotated (dumped) in the lower direction with respect to the lift arm 21 by retracting the rod 240.

The wheel loader 1 is a working machine for performing a loading operation that excavates earth, sand, minerals and the like in an opencast mine, for example, and loads them into a dump truck or the like. Next, V-shaped loading that is one of methods during the wheel loader 1 performing a digging operation and a loading operation, is described with reference to FIGS. 2 and 3.

Figure 2:
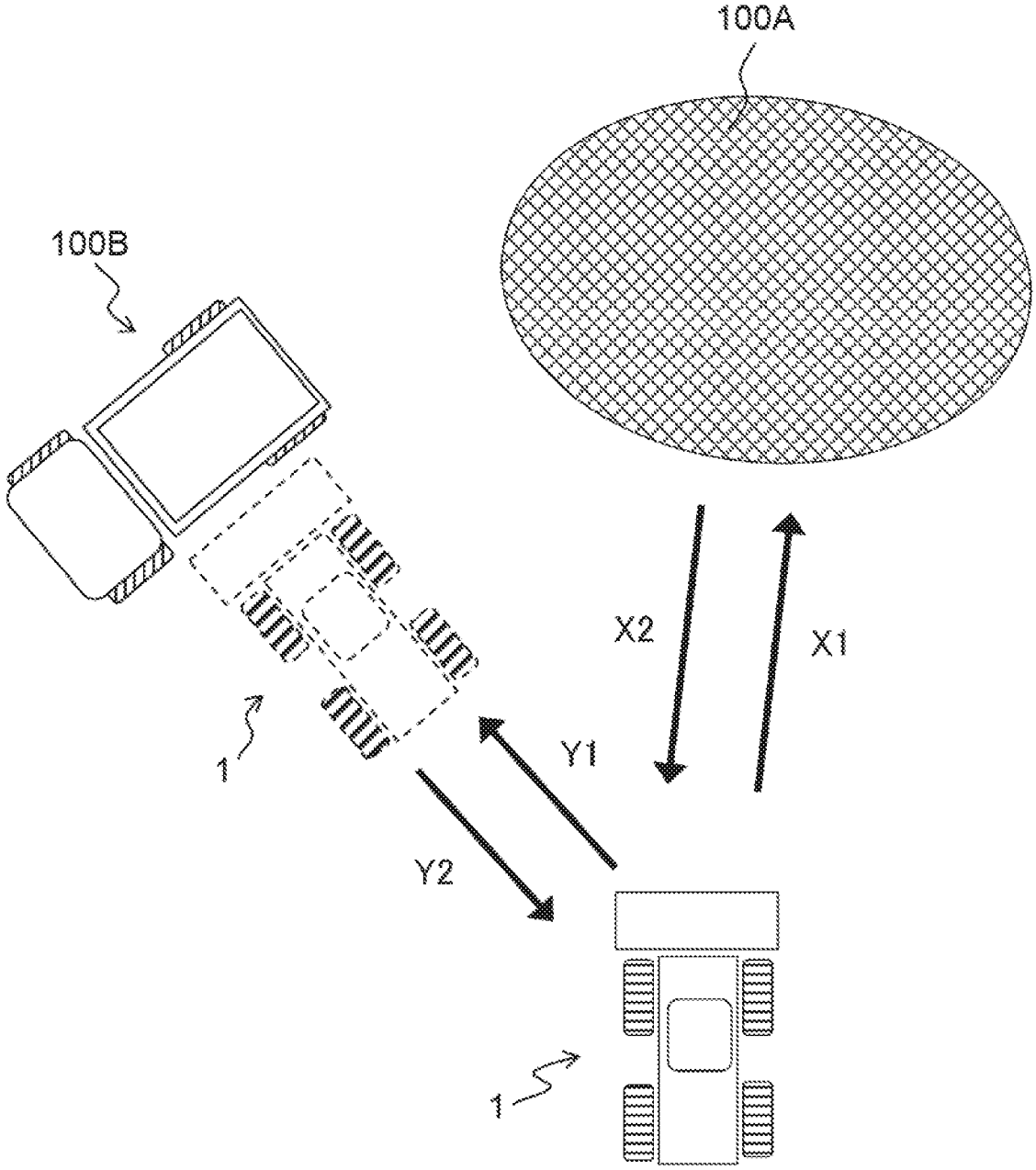
FIG. 2 illustrates V-shaped loading by the wheel loader.

FIG. 2 illustrates the V-shaped loading by the wheel loader 1. FIG. 3 illustrates a raise and run operation of the wheel loader 1.

First, as indicated by an arrow X1, the wheel loader 1 advances toward a ground 100A that is to be dug, and digs the bucket 23 into the ground 100A and performs the digging operation. After completion of the digging operation, the wheel loader 1 once goes back to the original position as indicated by an arrow X2.

Next, as indicated by an arrow Y1, the wheel loader 1 advances toward a dump truck 100B, and stops in front of the dump truck 100B. In FIG. 2, the wheel loader 1 in the state of stopping in front of the dump truck 100B is indicated by broken lines.

Figure 3:
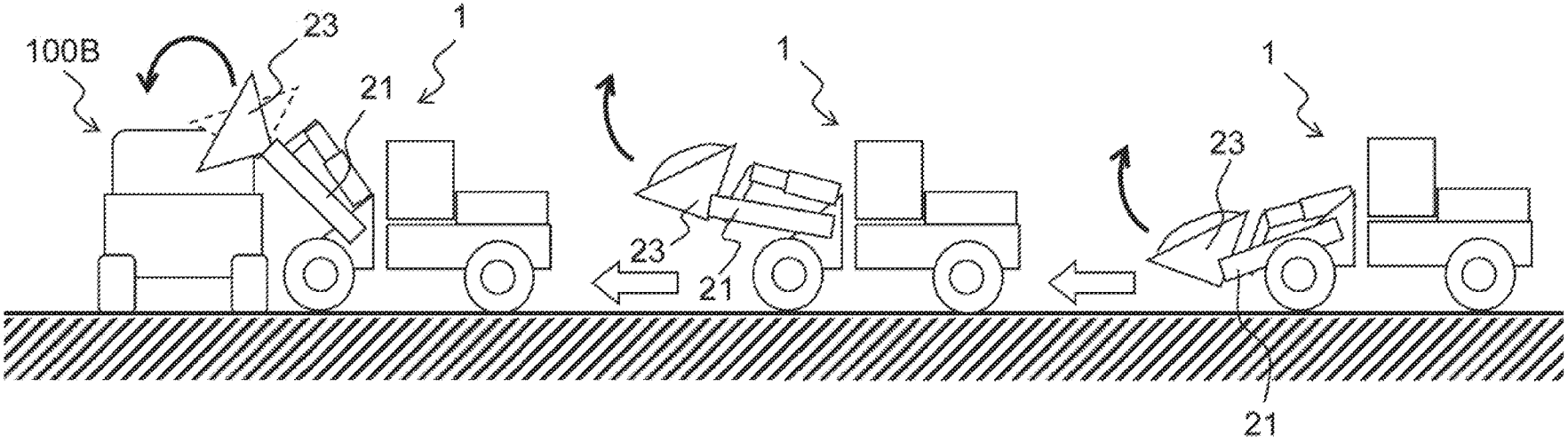
FIG. 3 illustrates a raise and run operation of the wheel loader.

Specifically, as shown in FIG. 3, the operator presses the accelerator pedal to the floor (fully accelerating), while performing a lifting operation for the lift arm 21 (a state shown at the right in FIG. 3). Next, with the fully accelerating state being kept, the lift arm 21 is further lifted in the upper direction (a state shown at the middle in FIG. 3). The operator then brakes to stop in front of the dump truck 100B, and dumps a load (earth, sand, minerals and the like) from the bucket 23 to load it into the dump truck 100B. Note that this series of operations shown in FIG. 3 is called a "raise and run operation."

After completion of the loading operation, the wheel loader 1 goes back to the original position as indicated by an arrow Y2 in FIG. 2. As described above, the wheel loader 1 travels to and fro between the ground 100A and the dump truck 100B in a V-shaped manner to perform the digging operation and the loading operation.

Next, a drive system of the wheel loader 1 is described with respect to each embodiment.

First Embodiment

The drive system of a wheel loader 1 according to a first embodiment of the present invention is described with reference to FIGS. 4 to 12.

(Travel Drive System)

First, the travel drive system of the wheel loader 1 is described with reference to FIGS. 4 to 6.

Figure 4:
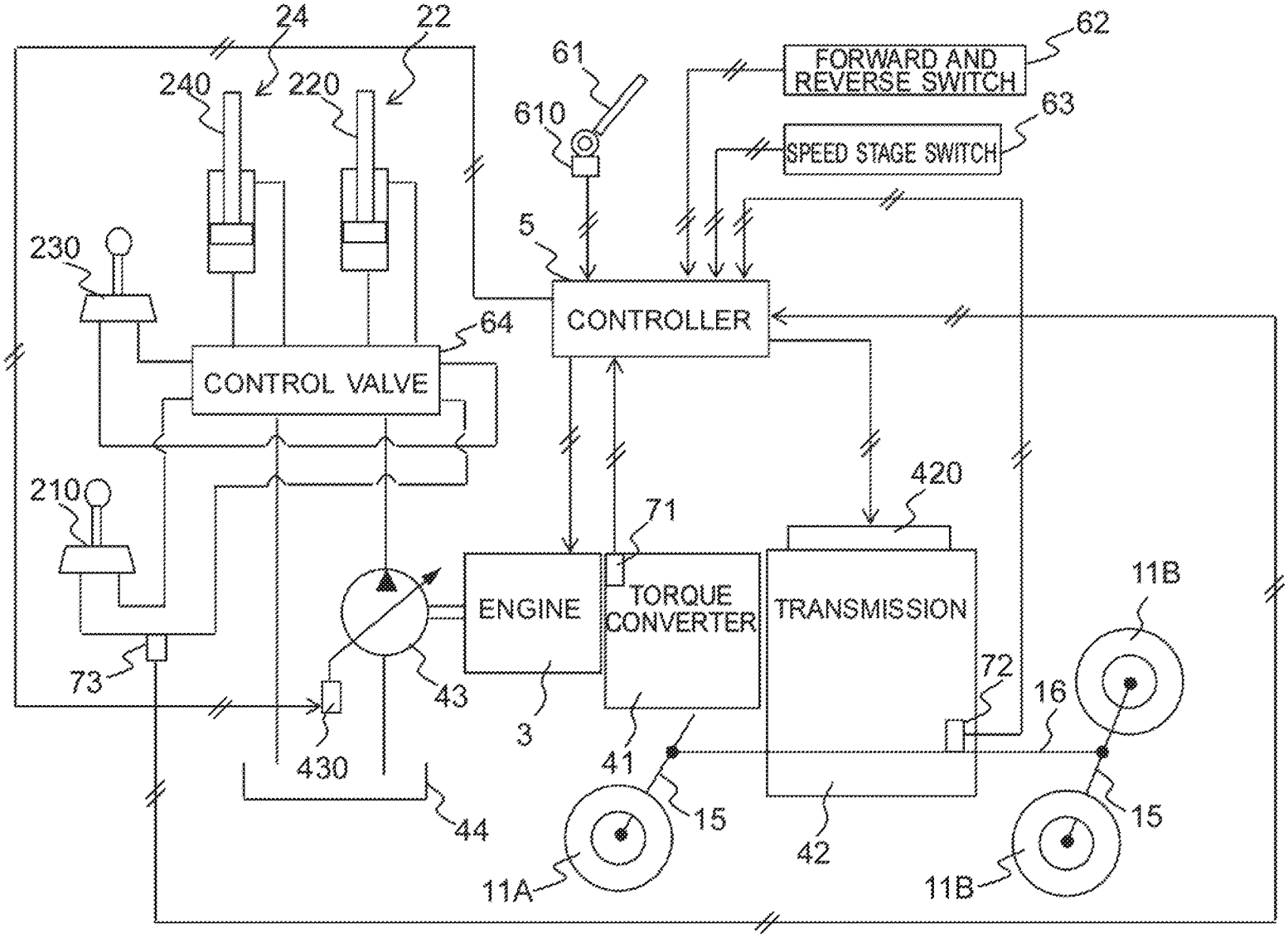
FIG. 4 shows a hydraulic circuit and an electric circuit of the wheel loader according to a first embodiment.

FIG. 4 shows a hydraulic circuit and an electric circuit of the wheel loader 1 according to this embodiment. FIG. 5 is a graph showing the relationship between an accelerator pedal stepping amount and a target engine rotational speed. FIG. 6 is a graph showing the relationship between the vehicle speed and the drive force for each speed stage.

As for the wheel loader 1 according to this embodiment, the travel of the vehicle body is controlled by the torque converter type travel drive system. As shown in FIG. 4, the wheel loader 1 includes: an engine 3; a torque converter 41 that includes an input shaft joined to the output shaft of the engine 3; a transmission 42 joined to an output shaft of the torque converter 41; and a controller 5 that controls each device, such as the engine 3.

The torque converter 41 is a fluid clutch that includes an impeller, a turbine and a stator, and has a function of increasing the output torque with respect to the input torque, that is, a function of causing the torque ratio (=output torque/input torque) to be one or more. The torque ratio decreases with increase in the torque converter speed ratio (=output shaft rotational speed/input shaft rotational speed) that is the ratio of the rotational speed of the input shaft and the rotational speed of the output shaft of the torque converter 41. Thus, the rotational speed of the engine 3 is changed and is transmitted to the transmission 42.

Figure 6:
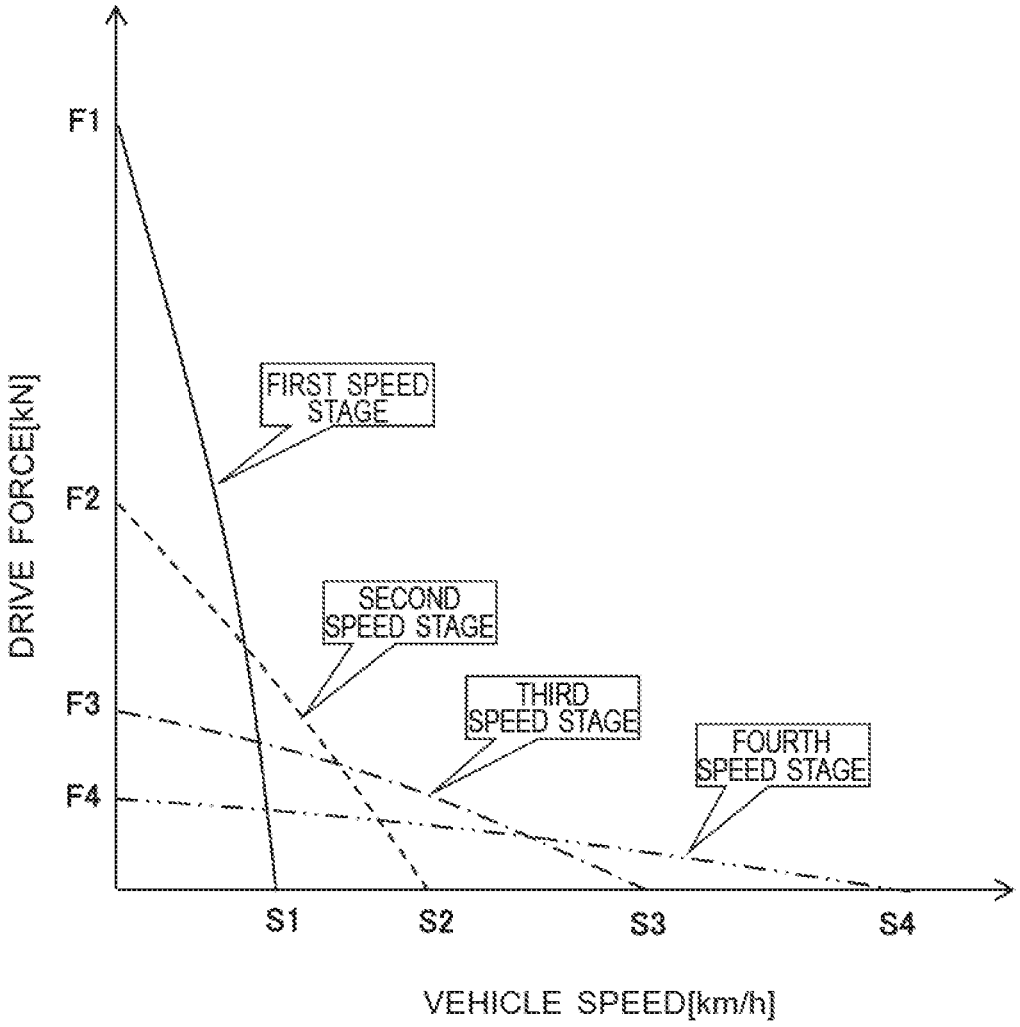
FIG. 6 is a graph showing the relationship between the vehicle speed and the drive force for each speed stage.

The transmission 42 is a variable speed gearbox that includes a plurality of solenoid valves for respective maximum vehicle speeds corresponding to first to fourth speed stages as shown in FIG. 6, and changes the rotational speed of the output shaft of the torque converter 41. Selection from among the first to fourth speed stages is performed through a speed stage switch 63 (see FIG. 4) provided in the operating room 12. The speed stage switch 63 is mainly used for forward travel of the wheel loader 1.

When the operator selects a desired speed stage through the speed stage switch 63, a speed stage signal pertaining to the selected speed stage is output from the speed stage switch 63 to the controller 5. According to the speed stage signal output from the controller 5 to the transmission control unit 420, the solenoid valves of the transmission 42 are driven.

As shown in FIG. 6, the maximum vehicle speed is set to S1 at the first speed stage, the maximum vehicle speed is set to S2 at the second speed stage, the maximum vehicle speed is set to S3 at the third speed stage, and the maximum vehicle speed is set to S4 at the fourth speed stage. Note that the magnitude relationship among S1, S2, S3 and S4 is S1<S2<S3<S4. In FIG. 6, the first speed stage is indicated by a solid line, the second speed stage is indicated by a broken line, the third speed stage is indicated by a chain line, and the fourth speed stage is indicated by a chain double-dashed line.

Among the first to fourth speed stages, the first speed stage and the second speed stage correspond to "low speed stage" and the third speed stage and the fourth speed stage correspond to "medium to high speed stages." The "low speed stage" is selected when the wheel loader 1 travels toward the dump truck 100B in the loading operation (in the case of indication by the arrow Y1 in FIG. 2), that is, at the time of raise and run operation, and the maximum vehicle speed is set to range from 9 to 15 km/hour, for example.

Selection of the traveling direction of the wheel loader 1, that is, selection between the forward travel and reverse travel is performed by a forward and reverse switch 62 provided in the operating room 12 (see FIG. 4). Specifically, when the operator selects the advance position by the forward and reverse switch 62, a forward and reverse switching signal indicating the forward travel is output to the controller 5, and the controller 5 outputs, to the transmission control unit 420, a command signal for bringing a forward clutch of the transmission 42 into an engaged state. When the transmission control unit 420 receives a command signal pertaining to forward travel, a clutch control valve provided for the transmission control unit 420 operates to bring a forward clutch into an engaged state, and the vehicle body is switched to forward travel. Reverse travel of the vehicle body is selected also by a similar mechanism.

As for the torque converter type travel drive system, first, the operator presses the accelerator pedal 61 provided in the operating room 12 to rotate the engine 3, and the input shaft of the torque converter 41 is rotated according to the rotation of the engine 3. The output shaft of the torque converter 41 rotates according to the set torque converter speed ratio, and the output torque of the torque converter 41 is transmitted to the front wheels 11A and the rear wheels 11B via the transmission 42, a propeller shaft 16 and an axle 15, thereby allowing the wheel loader 1 to travel.

Specifically, as shown in FIG. 4, the stepping amount on the accelerator pedal 61 detected by a stepping amount sensor 610 is input into the controller 5. A target engine rotational speed is input as the command signal from the controller 5 to the engine 3. The number of revolutions of the engine 3 is controlled in conformity with the target engine rotational speed. The rotational speed of the engine 3 is detected by a first engine rotational speed sensor 71 provided at an output shaft of the engine 3.

Figure 5:
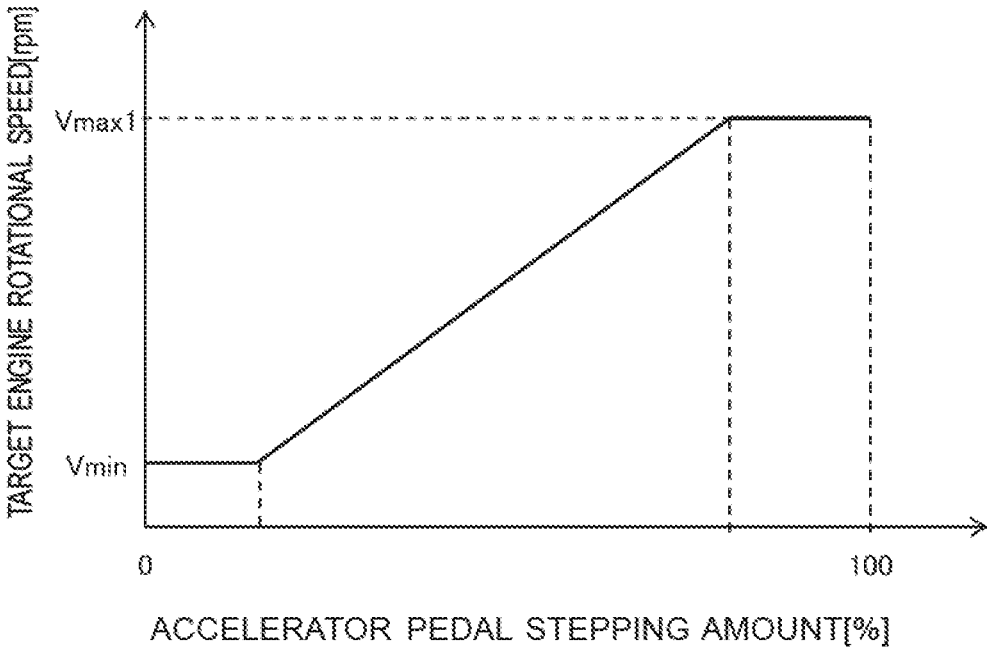
FIG. 5 is a graph showing the relationship between an accelerator pedal stepping amount and a target engine rotational speed.

As shown in FIG. 5, the stepping amount on the accelerator pedal 61 and the target engine rotational speed have a proportional relationship. The more the stepping amount on the accelerator pedal 61 is, the higher the target engine rotational speed is. Accordingly, the rotational speed of the output shaft of the torque converter 41 increases, which in turn increases the vehicle speed. As shown in FIG. 4, the vehicle speed is detected as the rotational speed of the propeller shaft 16 by a second rotational speed sensor 72.

Note that in FIG. 5, in a range of the stepping amount on the accelerator pedal 61 from 0% to 20% or 30%, the target engine rotational speed is constant at the minimum target engine rotational speed Vmin irrespective of the stepping amount on the accelerator pedal 61. In a range of the stepping amount on the accelerator pedal 61 from 70% or 80% to 100%, the target engine rotational speed is constant at the maximum target engine rotational speed Vmax irrespective of the stepping amount on the accelerator pedal 61.

As described above, with respect to the relationship between the stepping amount on the accelerator pedal 61 and the target engine rotational speed, setting is configured so as to maintain the target engine rotational speed at the minimum target engine rotational speed Vmin in a predetermined range with a small stepping amount on the accelerator pedal 61, and to maintain the target engine rotational speed at the maximum target engine rotational speed Vmax in a predetermined range with a large stepping amount on the accelerator pedal 61. Note that such setting can be freely changed.

(Drive System of Front Working Device 2)

Next, the drive system of the front working device 2 is described with reference to FIGS. 4 and 7.

Figure 7:
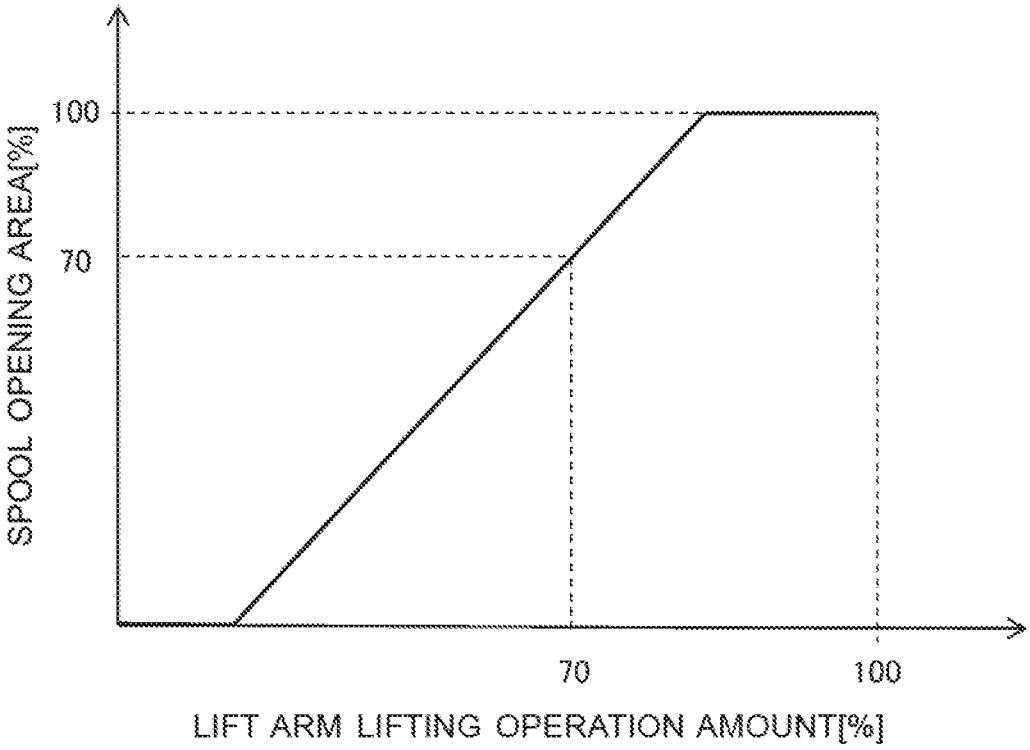
FIG. 7 is a graph showing the relationship between the lift arm lifting operation amount and the opening area of the spool.

FIG. 7 is a graph showing the relationship between the lifting operation amount for the lift arm 21 and the opening area of the spool.

As shown in FIG. 4, the wheel loader 1 is driven by the engine 3, and includes: an hydraulic pump 43 that supplies the front working device 2 with hydraulic oil; a hydraulic oil tank 44 that stores the hydraulic oil; a lift arm operating lever 210 for operating the lift arm 21; a bucket operating lever 230 for operating the bucket 23; and control valves 64 that control the flow of pressurized oil supplied from the hydraulic pump 43 to the lift arm cylinders 22 and the bucket cylinder 24.

In this embodiment, the hydraulic pump 43 is a swash-plate or bent-axis type variable displacement hydraulic pump whose displacement volume is controlled in response to a tilt angle. The tilt angle is adjusted by a regulator 430 according to a command signal output from the controller 5. Note that the hydraulic pump 43 is not necessarily a variable displacement hydraulic pump. A fixed displacement hydraulic pump may be adopted, instead.

When the operator operates the lift arm operating lever 210 in the direction of lifting the lift arm 21, for example, the pilot pressure in response to the operation amount is generated. The pilot pressure corresponds to the lifting operation amount for the lift arm 21 through the lift arm operating lever 210, and is detected by the operation amount sensor 73.

The generated pilot pressure is applied to the control valve 64, and the spool in the control valve 64 moves in a stroke according to the pilot pressure. The hydraulic oil discharged from the hydraulic pump 43 flows into the lift arm cylinders 22 via the control valve 64, thereby extending the rods 220 of the lift arm cylinders 22.

Consequently, as shown in FIG. 7, the lifting operation amount [%] for the lift arm 21 and the spool opening area [%] of the control valve 64 have a proportional relationship. As the lifting operation amount for the lift arm 21 increases, the spool opening area increases accordingly. Consequently, when the lift arm operating lever 210 is operated largely in the direction of lifting the lift arm 21, the hydraulic oil flow rate into the lift arm cylinders 22 increases to extend rapidly the rods 220 accordingly.

Note that in FIG. 7, in a range of the lifting operation amount for the lift arm 21 from 0% to 20%, the spool is not opened, and the opening area is 0% (dead zone). In a range of the lifting operation amount for the lift arm 21 from 85% to 100%, the spool opening area is constant at 100%, and a full lever operation state is maintained.

Also as for the operation of the bucket 23, similar to the operation of the lift arm 21, the pilot pressure generated in response to the operation amount for the bucket operating lever 230 acts on the control valve 64, which controls the spool opening area of the control valve 64, and adjusts the hydraulic oil flow rate into and from the bucket cylinder 24.

Although illustration is omitted in FIG. 4, operation amount (pilot pressure) sensors for detecting the lowering operation amount for the lift arm 21, and tilt and dump operation amounts for the bucket 23 are provided on the respective pipe lines of the hydraulic circuit.

(Configuration and Functions of Controller 5)

Next, the configuration and functions of the controller 5 are described with reference to FIGS. 8 to 12.

Figure 8:
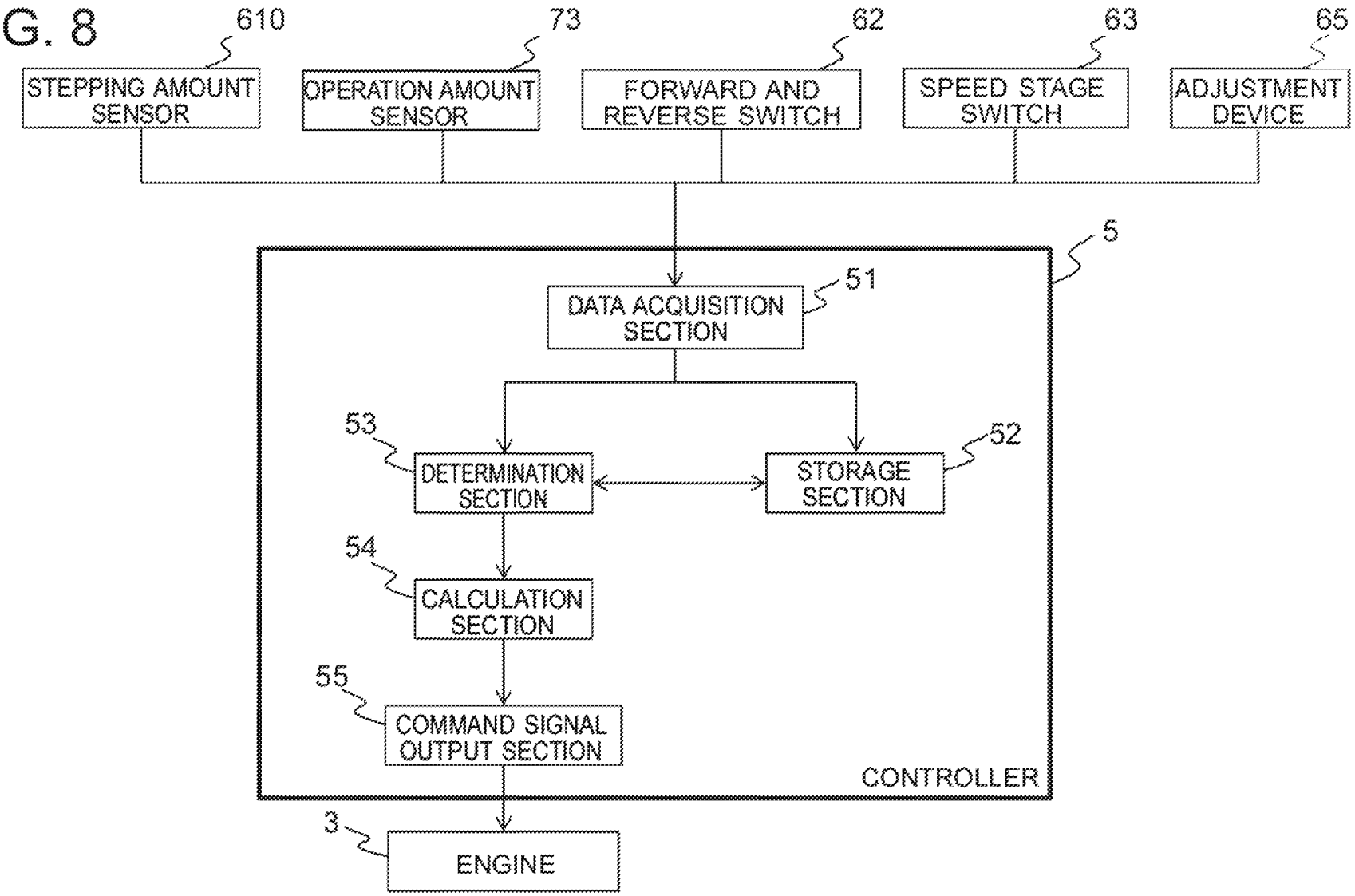
FIG. 8 is a functional block diagram showing functions that a controller has.
Figure 9:
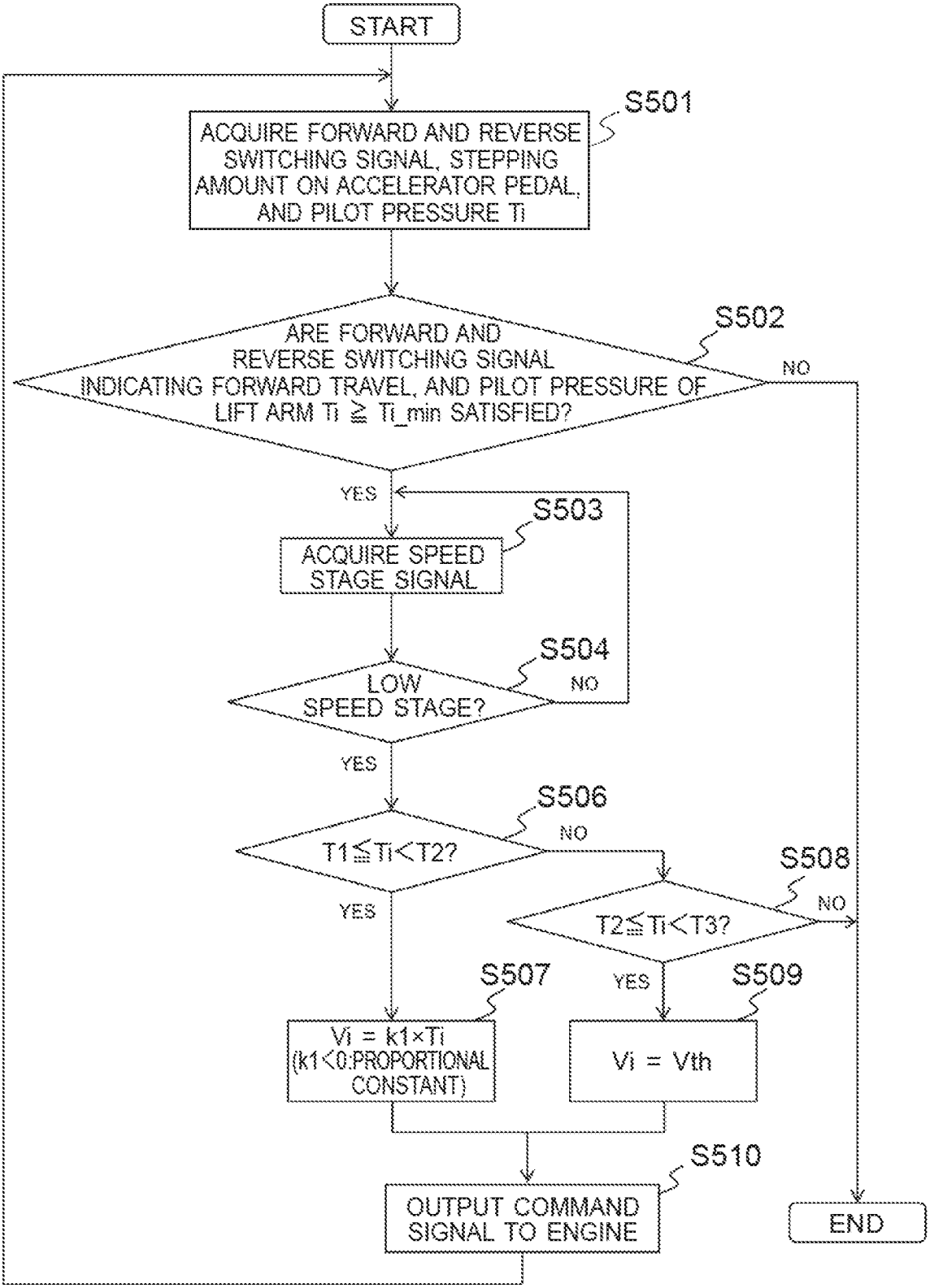
FIG. 9 is a flowchart showing the flow of processes executed by the controller.
Figure 10:
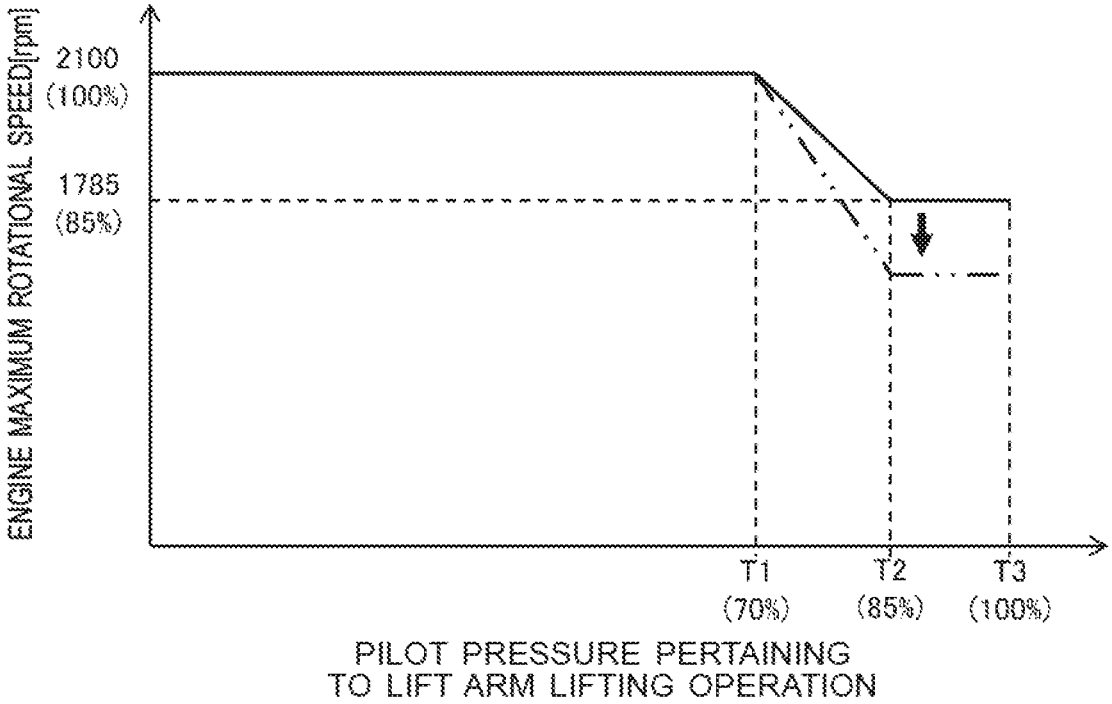
FIG. 10 is a graph showing the relationship between the lift arm lifting operation amount and the maximum rotational speed of an engine.
Figure 11:
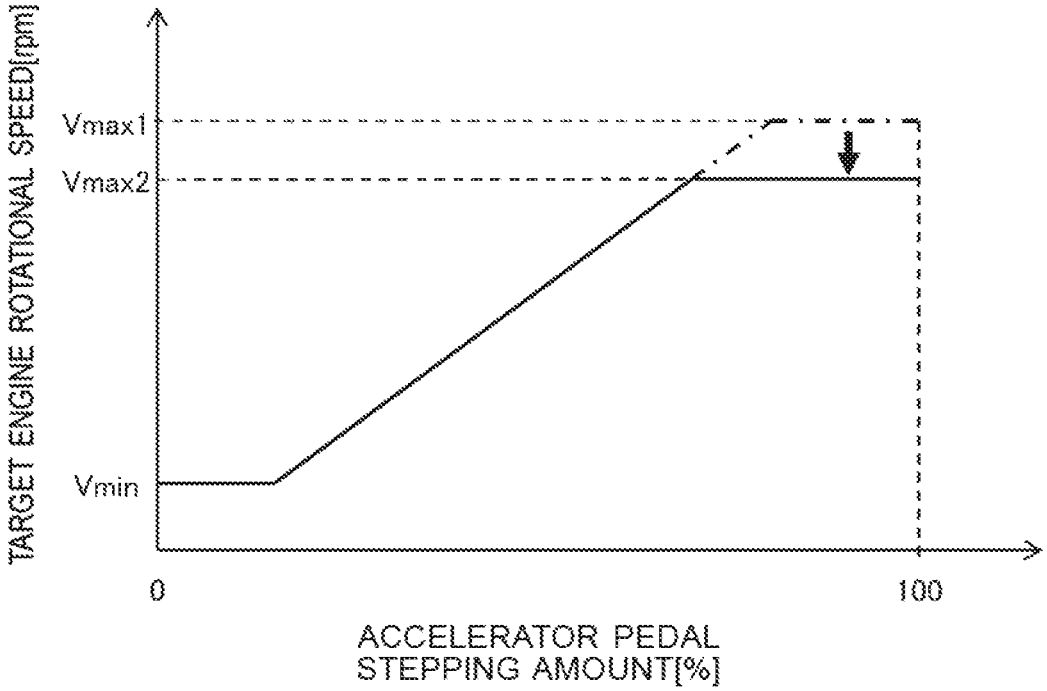
FIG. 11 is a graph showing the relationship between an accelerator pedal stepping amount and a target engine rotational speed in a case where the maximum rotational speed of the engine is limited.
Figure 12:
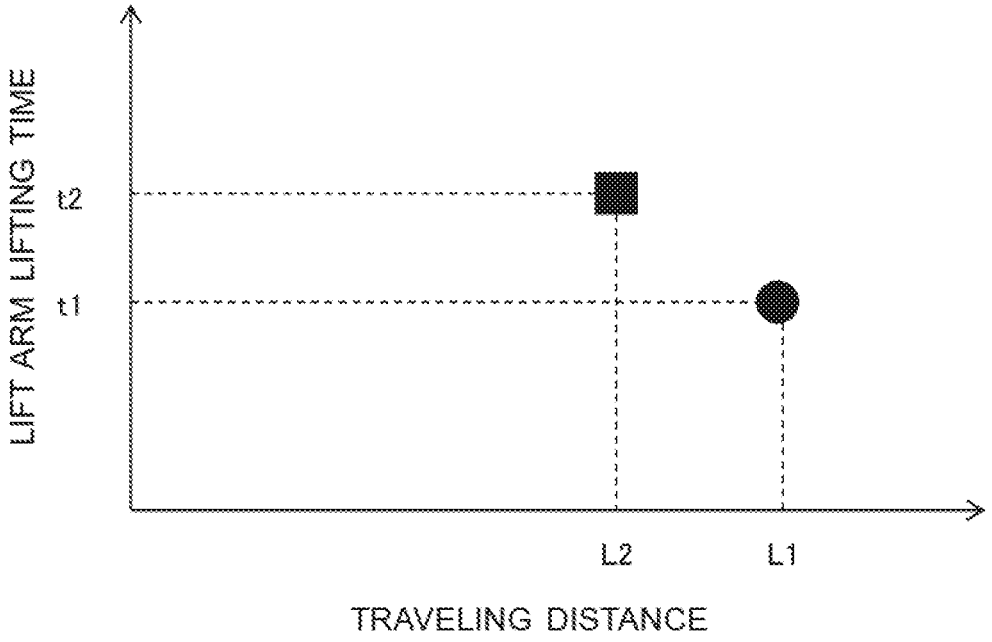
FIG. 12 is a graph showing the relationship between the traveling distance of the wheel loader and the lifting time of the lift arm.

FIG. 8 is a functional block diagram showing functions that the controller 5 has. FIG. 9 is a flowchart showing the flow of processes executed by the controller 5. FIG. 10 is a graph showing the relationship between the lifting operation amount of the lift arm 21 and the maximum rotational speed of the engine. FIG. 11 is a graph showing the relationship between the stepping amount on the accelerator pedal 61 and the target engine rotational speed in a case where the maximum rotational speed of the engine 3 is limited. FIG. 12 is a graph showing the relationship between the traveling distance of the wheel loader 1 and the lifting time of the lift arm 21.

The controller 5 is configured such that a CPU, a RAM, a ROM, an HDD, an input I/F, and an output I/F are connected to each other via a bus. The various operation devices, such as the forward and reverse switch 62 and the speed stage switch 63, the various sensors, such as the stepping amount sensor 610 and the operation amount sensor 73 (see FIG. 4), and the like are connected to the input I/F. The engine 3, the transmission control unit 420 of the transmission 42, the regulator 430 of the hydraulic pump 43 and the like are connected to the output I/F.

In such a hardware configuration, the CPU reads a calculation program (software) stored in a recording medium, such as the ROM, the HDD or an optical disk, deploys the program on the RAM, and executes the deployed calculation program, which allows the calculation program and the hardware to cooperate with each other, and achieves the functions of the controller 5.

In this embodiment, the configuration of the controller 5 is described with reference to the combination of the software and the hardware. Without limitation thereto, the configuration may be achieved using an integrated circuit that achieves the functions of the calculation program to be executed on the wheel loader 1.

As shown in FIG. 8, the controller 5 includes a data acquisition section 51, a storage section 52, a determination section 53, a calculation section 54, and a command signal output section 55.

The data acquisition section 51 acquires data items pertaining to the forward and reverse switching signal that has been output from the forward and reverse switch 62 and indicates forward or reverse travel, the stepping amount on the accelerator pedal 61 detected by the stepping amount sensor 610, the pilot pressure Ti as the lifting operation amount for the lift arm 21 detected by the operation amount sensor 73 (hereinafter, simply called "pilot pressure Ti"), and a speed stage signal output from the speed stage switch 63.

The storage section 52 stores a first pilot threshold T1, a second pilot threshold T2 and a third pilot threshold T3 that pertain to the pilot pressure for the lifting operation for the lift arm 21. The first pilot threshold T1 and the second pilot threshold T2 are pilot pressures in a state where the lift arm 21 is lifted in the upper direction higher than the lift arm 21 in a horizontal attitude. The second pilot threshold T2 is configured to have a larger value than the first pilot threshold T1 has (T1<T2). For example, in this embodiment, the first pilot threshold Ti is 70% (T1=70%), and the second pilot threshold T2 is 85% (T2=85%). Note that the first pilot threshold T1 may be a pilot pressure at least when the lift arm 21 is in the horizontal attitude in situations where the lift arm 21 is performing the lifting operation. The third pilot threshold T3 is a pilot pressure with the lift arm 21 having been completely lifted in the upper direction, that is, 100% (T3=100%).

The determination section 53 determines whether the wheel loader 1 is traveling forward or not on the basis of the forward and reverse switching signal acquired by the data acquisition section 51 and of the stepping amount on the accelerator pedal 61, and determines whether the lift arm 21 is in the lifting motion or not on the basis of the pilot pressure Ti acquired by the data acquisition section 51, for example, of whether the pilot pressure Ti of the lift arm 21 in the lifting direction is equal to or more than the minimum value Ti_min of the pilot pressure or not. Hereinafter, a condition for specifying the operation of the lift arm 21 in the upper direction during forward travel of the wheel loader 1 is regarded as a "specific condition." A case of satisfying the "specific condition" is a case of performing the raise and run operation described above.

Here, the forward and reverse switch 62 and the stepping amount sensor 610 are modes of a traveling state sensor that detects the traveling state of the vehicle body of the wheel loader 1. The operation amount sensor 73 is a mode of a motion sensor that detects the lifting motion for the lift arm 21.

Note that in this embodiment, advance travel of the vehicle body is determined on the basis of the forward and reverse switching signal that indicates forward travel and has been output from the forward and reverse switch 62 and of the stepping amount on the accelerator pedal 61 detected by the stepping amount sensor 610. Without limitation thereto, the forward travel of the vehicle body may be integrally determined in consideration of traveling states detected by other traveling state sensors mounted on the vehicle body.

In this embodiment, upon determination that the specific condition is satisfied (in the raise and run operation), the determination section 53 determines the magnitude relationship between the pilot pressure Ti and the first to third pilot thresholds T1, T2 and T3 on the basis of the pilot pressure Ti acquired by the data acquisition section 51 and of the first to third pilot thresholds T1, T2 and T3 read from the storage section 52. Furthermore, the determination section 53 determines whether the low speed stage is selected or not on the basis of the speed stage signal acquired by the data acquisition section 51.

When the determination section 53 determines that the specific condition is satisfied (in the raise and run operation), the calculation section 54 calculates the maximum rotational speed Vi of the engine 3. The command signal output section 55 outputs, to the engine 3, a command signal pertaining to the maximum rotational speed Vi of the engine 3 calculated by the calculation section 54.

Next, a flow of specific processes executed in the controller 5 is described.

As shown in FIG. 9, first, the data acquisition section 51 acquires the forward and reverse switching signal from the forward and reverse switch 62, the stepping amount on the accelerator pedal 61 from the stepping amount sensor 610, and the pilot pressure Ti from the operation amount sensor 73 (step S501).

Next, the determination section 53 determines whether the forward and reverse switching signal indicates forward travel or not (the wheel loader 1 is traveling forward or not) on the basis of the data items acquired in step S501, and determines whether the pilot pressure Ti of the lift arm 21 in the lifting direction is equal to or higher than the minimum value Ti_min of the pilot pressure or not (the lift arm 21 is performing the lifting motion or not) (step S502). That is, in step 502, it is determined whether the specific condition is satisfied or not.

If it is determined that the forward and reverse switching signal indicates forward travel and the pilot pressure Ti of the lift arm 21 in the lifting direction is equal to or higher than the minimum value Ti_min of the pilot pressure (Ti≥Ti_min) in step S502, that is, it is determined that the specific condition is satisfied (step S502/YES), the data acquisition section 51 acquires the speed stage signal from the speed stage switch 63 (step S503). On the contrary, if it is determined that the specific condition is not satisfied in step S502 (step S502/NO), the processes in the controller 5 are finished.

The determination section 53 determines whether the speed stage is the low speed stage or not on the basis of the speed stage signal acquired in step S503 (step S504). If it is determined that the speed stage is the low speed stage in step S504 (step S504/YES), the magnitude relationship between the pilot pressure Ti acquired in step S501 and the first pilot threshold T1 and second pilot threshold T2 read from the storage section 52 is determined. Specifically, the determination section 53 determines whether or not the pilot pressure Ti is equal to or higher than the first pilot threshold T1 and lower than the second pilot threshold T2 (step S506).

In step S506, when it is determined that the pilot pressure Ti is equal to or higher than the first pilot threshold T1 and is lower than the second pilot threshold T2 (T1≤Ti<T2) (step S506/YES), the calculation section 54 calculates the maximum rotational speed Vi of the engine 3 according to Vi=k1×Ti (k1<0: proportional constant) (step S507). The command signal output section 55 outputs, to the engine 3, the command signal pertaining to the maximum rotational speed Vi of the engine 3 calculated in step S507 (step S510).

That is, as shown in FIG. 10, when the detected pilot pressure Ti is a value ranging from the first pilot threshold T1 to the second pilot threshold T2 (T1≤Ti<T2), the controller 5 gradually reduces the maximum rotational speed Vi of the engine 3 to a predetermined value Vth such that the pilot pressure Ti and the maximum rotational speed Vi of the engine 3 satisfy an inversely proportional relationship, and limits (reduces) the vehicle speed. Accordingly, in this embodiment, only after the detected pilot pressure Ti reaches the first pilot threshold T1, the controller 5 executes a process for limiting the vehicle speed.

In FIG. 10, when the pilot pressure Ti is 70% (first pilot threshold T1), the maximum rotational speed Vi of the engine 3 is 2,100 [rpm], which is the rated value (=100%). When the pilot pressure Ti is 85% (second pilot threshold T2), the maximum rotational speed Vi of the engine 3 is 1,785 [rpm], which is 85% of the rated value. Thus, as the pilot pressure Ti increases from 70% to 85%, the maximum rotational speed Vi of the engine 3 is gradually limited from the 100% (rated value) to 85% (predetermined value Vth).

On the contrary, if it is not determined that the pilot pressure Ti is equal to or higher than the first pilot threshold T1 and is lower than the second pilot threshold T2 (T1 Ti<T2) in step S506 (step S506/NO), the determination section 53 further determines whether or not the pilot pressure Ti is equal to or higher than the second pilot threshold T2 and lower than the third pilot threshold T3 (step S508).

In step S508, when it is determined that the pilot pressure Ti is equal to or higher than the second pilot threshold T2 and is lower than the third pilot threshold T3 (T2 Ti<T3) (step S508/YES), the calculation section 54 calculates the maximum rotational speed Vi of the engine 3 as the predetermined value Vth (Vi=Vth) irrespective of increase in pilot pressure Ti (step S509). The command signal output section 55 outputs, to the engine 3, the command signal pertaining to the maximum rotational speed Vi (=Vth) of the engine 3 calculated in step S509 (step S510).

That is, as shown in FIG. 10, when the detected pilot pressure Ti is a value ranging from the second pilot threshold T2 (=85%) to the third pilot threshold T3 (=100%) (T2≤Ti<T3), the controller 5 limits (reduces) the vehicle speed so as to maintain the maximum rotational speed Vi of the engine 3 to be the predetermined value Vth (=1,785 rpm) irrespective of increase in pilot pressure Ti.

As described above, when it is determined that the forward and reverse switching signal is forward travel and the pilot pressure Ti of the lift arm 21 in the lifting direction is equal to or higher than the minimum value Ti_min of the pilot pressure (Ti Ti_min) in step S502, that is, the specific condition is satisfied (in the raise and run operation) (step S502/YES), the maximum rotational speed Vi of the engine 3 is limited, thereby limiting the target engine maximum rotational speed with respect to the stepping amount on the accelerator pedal 61 from Vmax1 to Vmax2 (Vmax1→Vmax2 and Vmax2<Vmax1) as shown in FIG. 11.

Accordingly, as shown in FIG. 12, during the raise and run operation, the discharge rate of the hydraulic pump 43 driven by the engine 3 decreases, and the time to the complete rise of the lift arm 21 in the upper direction (lifting time) extends from t1 to t2 (t1→t2 and t2>t1), which is longer than that in a case without limitation on the vehicle speed.

Meanwhile, the traveling distance from the wheel loader 1 to the dump truck 100B (the distance from the wheel loader 1 indicated by the solid line to the wheel loader 1 indicated by the broken line in FIG. 2), that is, the traveling distance required for the raise and run operation is reduced from L1 to L2 (L1→L2 and L2<L1), which is shorter than that in the case without limitation on the vehicle speed.

Without any limitation on the vehicle speed with respect to the lifting motion rate of the lift arm 21, the wheel loader 1 possibly reaches the front of the dump truck 100B before the lift arm 21 has been completely lifted in the upper direction. In this case, the traveling distance is required to be long. However, by the controller 5 limiting the vehicle speed in consideration of the lifting motion rate of the lift arm 21, the lift arm 21 can be completely lifted even with a small traveling distance. Accordingly, the cycle time of the operation of V-shaped loading is reduced, which improves the operation efficiency and reduces the fuel consumption of the wheel loader 1.

To determine whether the specific condition is satisfied or not, presence or absence of the lifting motion for the lift arm 21 is determined using the pilot pressure Ti detected by the operation amount sensor 73. Consequently, for example, in comparison with the case of detecting the bottom pressure of the lift arm cylinders 22, erroneous determinations of the lifting motion for the lift arm 21 can be reduced, and abrupt change in vehicle speed is suppressed. This is because of the following reasons. Unlike the case of using the bottom pressure of the lift arm cylinders 22, use of the pilot pressure generated by operating the lift arm operating lever 210 can directly detect the lifting motion for the lift arm 21. Accordingly, adverse effects of variation in pressure due to a load in the bucket 23 and vibrations of the vehicle body are small.

Furthermore, in this embodiment, only in the latter half of the raise and run operation, at least until the lift arm 21 is completely lifted from the horizontal attitude in the upper direction (with the pilot pressure ranging from 70% to 100% in FIG. 10), the maximum rotational speed (vehicle speed) of the engine 3 is limited by the controller 5. When the lifting motion for the lift arm 21 is not largely performed, the maximum rotational speed of the engine 3 is not limited. Accordingly, when the lifting motion for the lift arm 21 is not largely performed, the blow-up of the engine 3 can be improved to enhance the acceleration performance.

If it is not determined that the pilot pressure Ti is equal to or higher than the second pilot threshold T2 and is lower than the third pilot threshold T3 ($T2 \leq Ti < T3$) in step S508 (step S508/NO), that is, if the lift arm 21 is not subjected to a large lifting motion ($Ti < T1$), or if the raise and run operation has been completely finished ($Ti = T3$), the processes in the controller 5 are finished.

After the command signal output section 55 outputs the command signal to the engine 3 in step S510, the processing returns to step S501, and the processes are repeated.

This embodiment is configured such that if the speed stage is not the low speed stage in step S504 (step S504/NO), the processing returns to step S503, and does not proceed to the process of controlling the maximum rotational speed of the engine 3 to limit the vehicle speed (the processes in step S506 and thereafter) until the speed stage becomes the low speed stage. The low speed stage (in particular, the second speed stage in FIG. 6) is suitable for the raise and run operation. It is desirable to limit the vehicle speed only when the low speed stage is selected.

Note that the controller 5 may omit steps S503 and S504, and control the maximum rotational speed of the engine 3 irrespective of the type of the selected speed stage.

In this embodiment, the wheel loader 1 includes an adjustment device 65 as shown in FIG. 8. The adjustment device 65 allows the operator to adjust freely the change rate (proportional constant k1) of the maximum rotational speed of the engine 3 with respect to the pilot pressure Ti. The controller 5 stores the change rate preset in the storage section 52 by the adjustment device 65, and the calculation section 54 calculates the maximum rotational speed of the engine 3 in conformity with the stored change rate.

For example, if it is intended to limit largely the vehicle speed, the adjustment device 65 configures setting such that the change rate of the maximum rotational speed of the engine 3 with respect to the pilot pressure Ti is increased, as indicated by chain double-dashed lines in FIG. 10. As described above, the wheel loader 1 is provided with the adjustment device 65, which can freely adjust the limit on the vehicle speed in conformity with the preferences of the operator, the environment of the field site, etc., and improve the user-friendliness.

Second Embodiment

Next, a wheel loader 1 according to a second embodiment of the present invention is described with reference to FIGS. 13 to 16. In FIGS. 13 to 16, configuration elements common to those described on the wheel loader 1 according to the first embodiment are assigned the same symbols. The description thereof is omitted.

Figure 13:
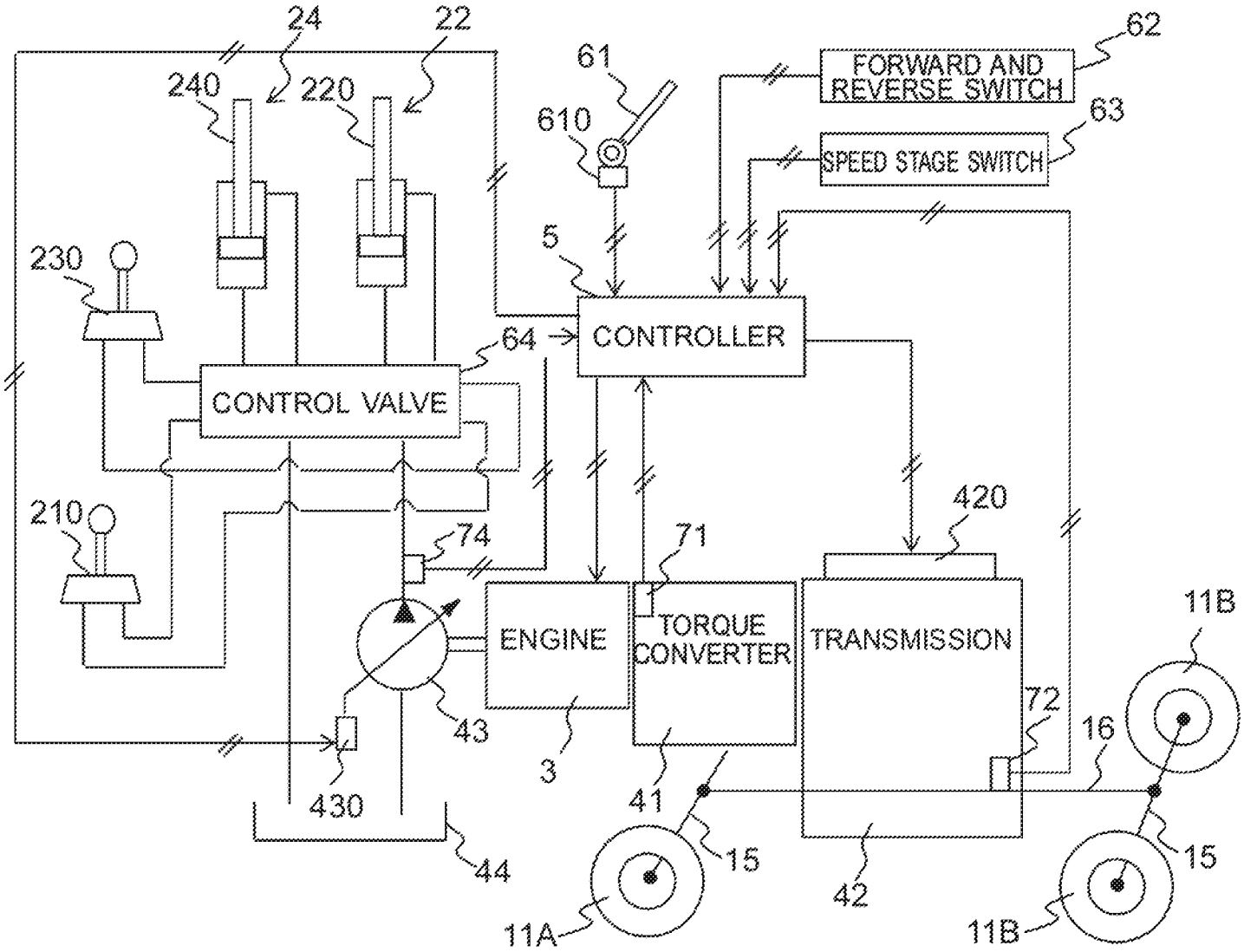
FIG. 13 shows a hydraulic circuit and an electric circuit of the wheel loader according to a second embodiment.
Figure 14:
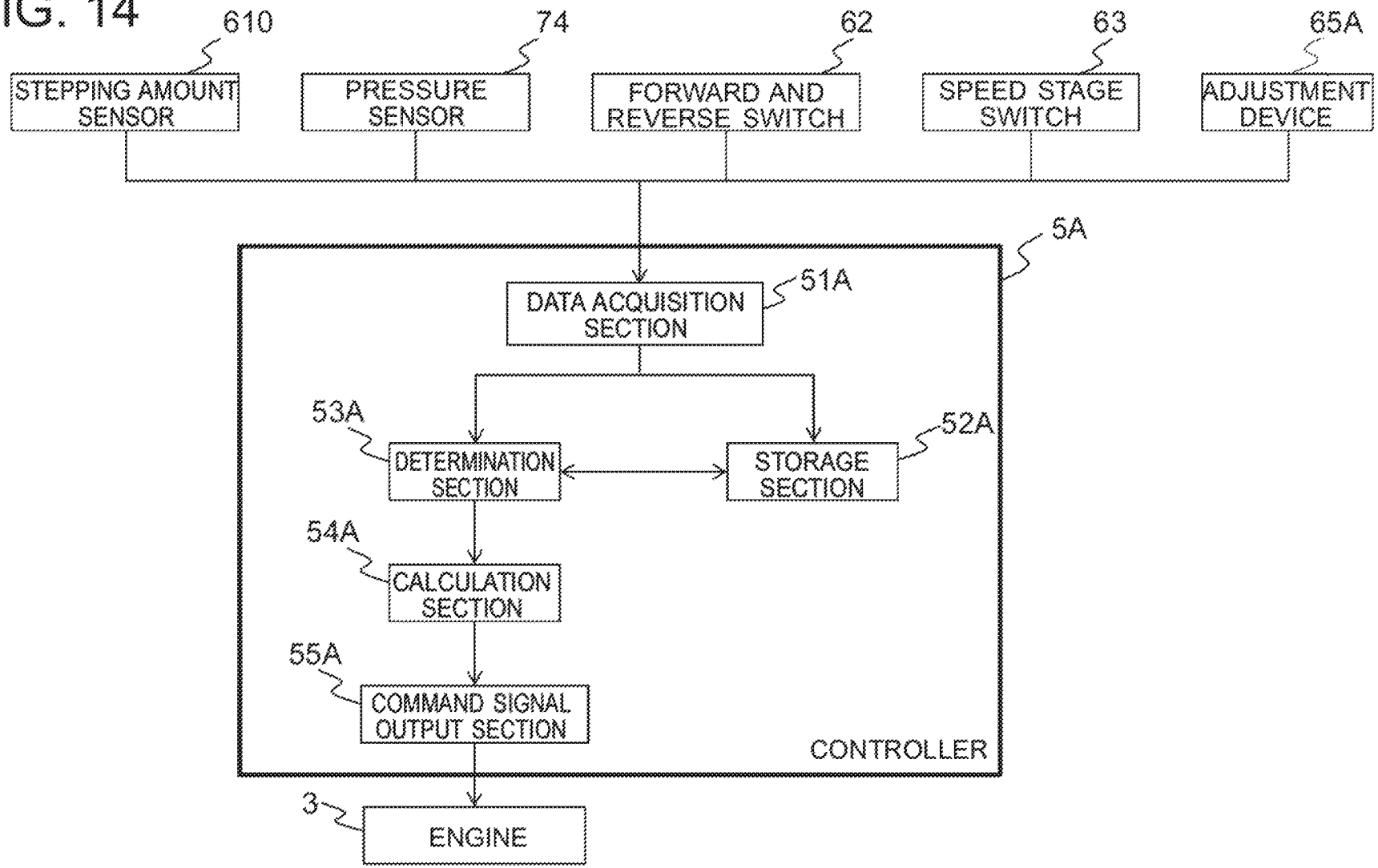
FIG. 14 is a functional block diagram showing functions that a controller according to the second embodiment has.
Figure 15:
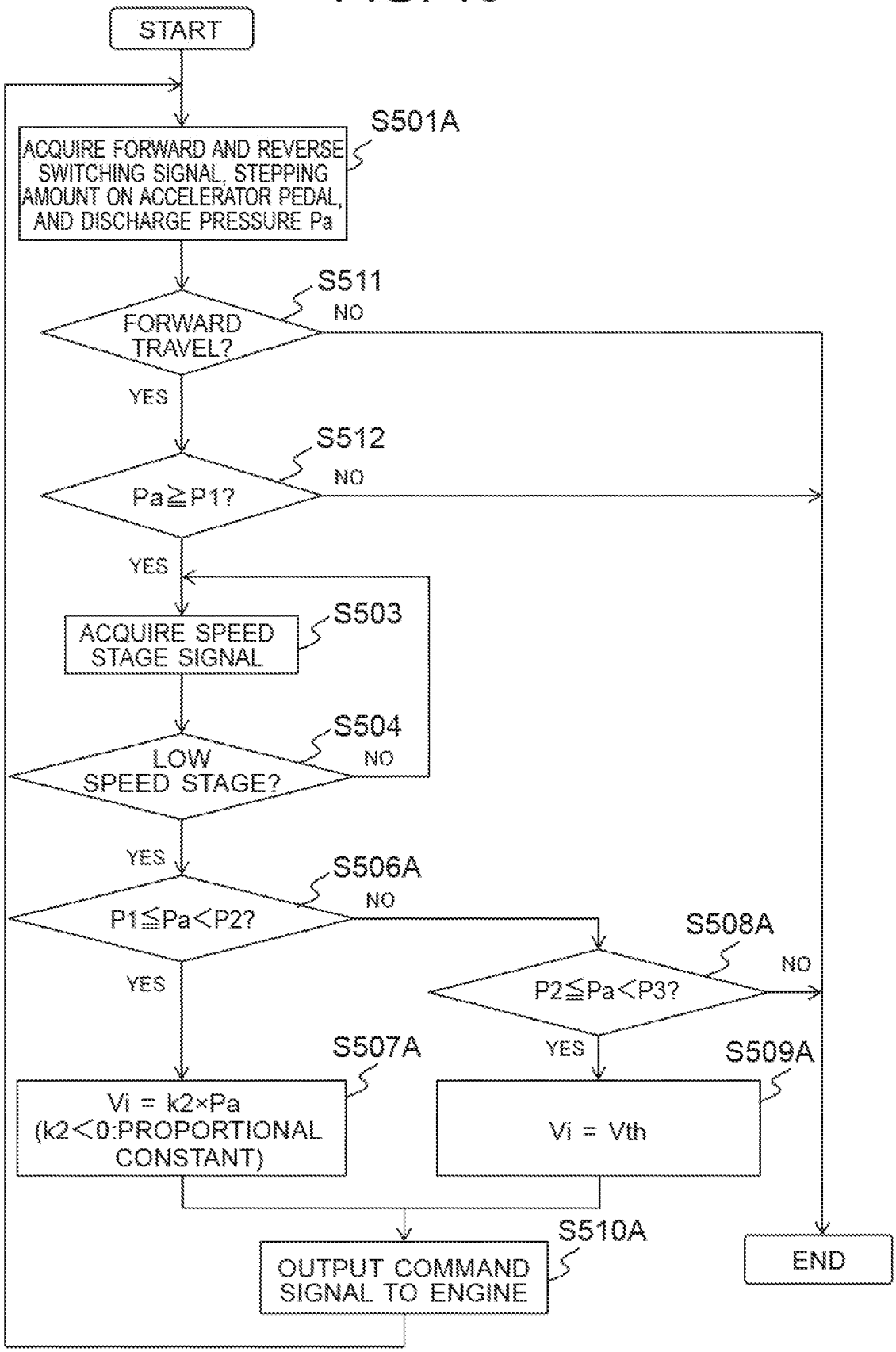
FIG. 15 is a flowchart showing the flow of processes executed by the controller according to the second embodiment.
Figure 16:
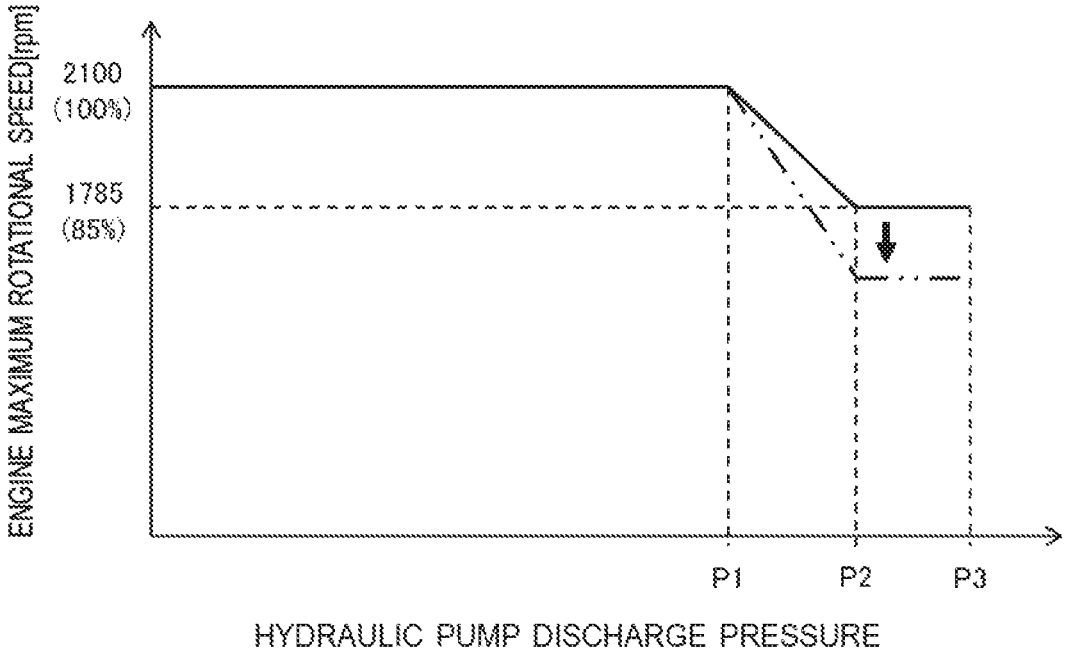
FIG. 16 is a graph showing the relationship between the discharge pressure of a hydraulic pump and the maximum rotational speed of the engine.

FIG. 13 shows a hydraulic circuit and an electric circuit of the wheel loader 1 according to the second embodiment. FIG. 14 is a functional block diagram showing functions that a controller 5A according to the second embodiment has. FIG. 15 is a flowchart showing the flow of processes executed by the controller 5A according to the second embodiment. FIG. 16 is a graph showing the relationship between the discharge pressure Pa of the hydraulic pump 43 and the maximum rotational speed Vi of the engine 3.

In the wheel loader 1 according to this embodiment, for determination of whether the specific condition is satisfied or not, the controller 5A determines whether the lift arm 21 is in the lifting motion or not, on the basis of the discharge pressure Pa of the hydraulic pump 43 in response to the lifting operation for the lift arm 21, instead of the pilot pressure Ti pertaining to the lifting operation for the lift arm 21.

Consequently, as shown in FIG. 13, the wheel loader 1 according to this embodiment includes a pressure sensor 74 that detects the discharge pressure Pa of the hydraulic pump 43, as a mode of a motion sensor that detects the lifting motion for the lift arm 21. Other configuration elements are similar to those of the first embodiment. The travel drive system in this embodiment is also a torque converter type travel drive system.

As shown in FIGS. 14 and 15, a data acquisition section 51A acquires data pertaining to the forward and reverse switching signal output from the forward and reverse switch 62, the stepping amount detected by the stepping amount sensor 610, the discharge pressure Pa of the hydraulic pump 43 detected by the pressure sensor 74, and the speed stage signal output from the speed stage switch 63 (step S501A).

Next, the determination section 53A determines whether the vehicle body is in forward travel or not on the basis of the forward and reverse switching signal and the stepping amount on the accelerator pedal 61 acquired in step S501A (step S511).

When it is determined to be in forward travel in step S511 (step S511/YES), the determination section 53A determines the magnitude relationship between the discharge pressure Pa of the hydraulic pump 43 acquired in step S501A and the first pump threshold P1 read from a storage section 52A (step S512). That is, in step S512, it is determined whether the lift arm 21 is performing the lifting motion or not.

As described above, unlike the case of using the bottom pressures of the lift arm cylinders 22, also in a case of using the discharge pressure Pa detected by the pressure sensor 74 to determine presence or absence of the lifting motion for the lift arm 21, adverse effects of variation in pressure due to a load in the bucket 23, vibrations of the vehicle body and the like are small. Accordingly, erroneous determination of the lifting operation for the lift arm 21 can be reduced and therefore the increase rate of the lift arm 21 and abrupt change in vehicle speed are suppressed.

The storage section 52A stores the first pump threshold P1, a second pump threshold P2 and a third pump threshold P3 that pertain to the discharge pressure of the hydraulic pump 43 and are required when the lift arm 21 lifts the bucket 23 in a state of being loaded. The first pump threshold P1 is the discharge pressure of the hydraulic pump 43 when the lift arm 21 starts the operation of lifting upward the bucket 23 in the state of being loaded. The second pump threshold P2 is the discharge pressure of the hydraulic pump 43 when the lift arm 21 is in a horizontal attitude. The third pump threshold P3 is the discharge pressure of the hydraulic pump 43 when the lift arm 21 has been completely lifted in the upper direction, that is, a relief pressure.

If it is determined that the discharge pressure Pa is equal to or higher than the first pump threshold P1 in step S512 (Pa P1), that is, it is determined that the lift arm 21 is performing the lifting motion (step S512/YES), the processing proceeds to the process in step S503.

On the other hand, if it is determined that the vehicle is not in forward travel in step S511 (in a stop state or during reverse travel) (step S511/NO), and if it is determined that the discharge pressure Pa is lower than the first pump threshold P1 in step S512 (Pa<P1), that is, it is determined that the lift arm 21 is not performing the lifting motion (step S512/NO), the processing in the controller 5A is finished. This is because the specific condition is not satisfied in these cases. In other words, in this embodiment, "the case of satisfying the specific condition" is at least YES in step S511 and YES in step S512.

In step S506A, the determination section 53A determines the magnitude relationship between the discharge pressure Pa acquired in step S501A and the first pump threshold P1 and second pump threshold P2 read from the storage section 52A. Specifically, the determination section 53A determines whether or not the discharge pressure Pa is equal to or higher than the first pump threshold P1 and is lower than the second pump threshold P2.

In step S506A, when it is determined that the discharge pressure Pa is equal to or higher than the first pump threshold P1 and is lower than the second pump threshold P2 (P1≤Pa<P2) (step S506A/YES), the calculation section 54A calculates the maximum rotational speed Vi of the engine 3 according to Vi=k2×Pa (k2<0: proportional constant) (step S507A). The command signal output section 55A outputs, to the engine 3, the command signal pertaining to the maximum rotational speed Vi of the engine 3 calculated in step S507A (step S510A).

That is, as shown in FIG. 16, when the detected discharge pressure Pa is a value ranging from the first pump threshold P1 to the second pump threshold P2 (P1≤Pa<P2), the controller 5A gradually reduces the maximum rotational speed Vi of the engine 3 to a predetermined value Vth (=1,785 rpm) such that the discharge pressure Pa and the maximum rotational speed Vi of the engine 3 satisfy an inversely proportional relationship, and limits (reduces) the vehicle speed.

On the contrary, if it is not determined that the discharge pressure Pa is equal to or higher than the first pump threshold P1 and is lower than the second pump threshold P2 (P1≤Pa<P2) in step S506A (step S506A/NO), the determination section 53A further determines whether or not the discharge pressure Pa is equal to or higher than the second pump threshold P2 and is lower than the third pump threshold P3 (step S508A).

In step S508A, when it is determined that the discharge pressure Pa is equal to or higher than the second pump threshold P2 and is lower than the third pump threshold P3 (P2≤Pa<P3) (step S508/YES), the calculation section 54A calculates the maximum rotational speed Vi of the engine 3 as the predetermined value Vth (Vi=Vth) irrespective of increase in discharge pressure Pa (step S509A). The command signal output section 55A outputs, to the engine 3, the command signal pertaining to the maximum rotational speed Vi (=Vth) of the engine 3 calculated in step S509A (step S510A).

That is, as shown in FIG. 16, when the detected discharge pressure Pa pertaining to the lifting operation for the lift arm 21 is a value ranging from the second pump threshold P2 to the third pump threshold P3 (P2≤Pa<P3), the controller 5A limits (reduces) the vehicle speed so as to maintain the maximum rotational speed Vi of the engine 3 to be the predetermined value Vth (=1,785 rpm) irrespective of increase in discharge pressure Pa.

As described above, in the case of satisfying the specific condition, the controller 5A may limit the vehicle speed by reducing the maximum rotational speed of the engine 3 according to increase in the discharge pressure Pa of the hydraulic pump 43. At this time, irrespective of the discharge pressure Pa of the hydraulic pump 43 pertaining to the lifting operation for the lift arm 21, the vehicle speed may be limited in response to increase in the input torque of the hydraulic pump 43 pertaining to the lifting operation for the lift arm 21.

The controller 5A thus limits the vehicle speed on the basis of the discharge pressure Pa of the hydraulic pump 43 detected by the pressure sensor 74 (the input torque). Without limitation thereto, the vehicle speed may be limited on the basis of the average discharge pressure Pav (average input torque) in a predetermined setting time period. In this case, even if the detected value varies due to occurrence of instantaneous large vibrations, collision or the like at the vehicle body, the vehicle speed can be stably limited using the average value.

As shown in FIG. 16, in this embodiment, in the former half of the raise and run operation, that is, until the lift arm 21 is in the horizontal attitude after start of the lifting operation for the lift arm 21, the maximum rotational speed Vi of the engine 3 is gradually reduced to the predetermined value Vth as the discharge pressure Pa of the hydraulic pump 43 increases. Accordingly, the vehicle speed is smoothly limited, and the vibrations and shocks on the vehicle body and the operator accompanied by abrupt reduction in speed can be suppressed.

As shown in FIG. 14, similar to the first embodiment, the wheel loader 1 according to this embodiment may include an adjustment device 65A that can adjust the change rate (proportional constant k2) of the maximum rotational speed Vi of the engine 3 with respect to the discharge pressure Pa of the hydraulic pump 43 pertaining to the lifting operation for the lift arm 21.

The embodiments of the present invention have thus been described above. Note that the present invention is not limited to the embodiments described above, and encompasses various modification examples. For example, the aforementioned embodiments are detailed description for illustrating the present invention in an understandable manner, and does not necessarily impose limitation to those including the entire configuration described above. A part of the configuration of each of the embodiments can be replaced with configuration elements of another embodiment. To the configurations of the embodiments, configuration elements of another embodiment can be added. Alternatively, a part of the configuration of the embodiment can be subjected to addition, removal and replacement of other configuration elements.

For example, based on the pilot pressure Ti detected by the operation amount sensor 73 in the first embodiment, and based on the discharge pressure Pa of the hydraulic pump 43 detected by the pressure sensor 74 in the second embodiment, it is determined whether the lift arm 21 is performing the lifting motion or not. Without limitation thereto, based on both the pilot pressure Ti detected by the operation amount sensor 73 and the discharge pressure Pa of the hydraulic pump 43 detected by the pressure sensor 74, it may be determined whether the lift arm 21 is performing the lifting motion or not. In this case, in comparison with the case of determining the lifting motion for the lift arm 21 using only any one, erroneous determination of the lifting motion for the lift arm 21 can be further reduced.

REFERENCE SIGNS LIST

1: Wheel loader
2: Front working device
3: Engine
5, 5A: Controller
11A: Front wheel
11B: Rear wheel
21: Lift arm
41: Torque converter
43: Hydraulic pump
62: Forward and reverse switch (traveling state sensor)
63: Speed stage switch
65, 65A: Adjustment device
73: Operation amount sensor (motion sensor)
74: Pressure sensor (motion sensor)
100B: Dump truck
610: Stepping amount sensor (traveling state sensor)

The invention claimed is:

1. A wheel loader including a front working device including a lift arm rotatable in a vertical direction, the front working device being provided at a front of a vehicle body, the wheel loader traveling by transmitting a drive force of an engine to wheels via a torque converter, and comprising:

a traveling state sensor that detects a traveling state of the vehicle body;

a motion sensor that detects that the lift arm is in a lifting motion; and a controller that controls the engine, wherein the controller determines whether a specific condition for specifying an operation of the lift arm in an upper direction during forward travel of the vehicle body is satisfied or not, based on the traveling state detected by the traveling state sensor, and on a state of a lifting motion of the lift arm detected by the motion sensor, and in a case where the specific condition is satisfied, reduces a maximum rotational speed of the engine more than a maximum rotational speed of the engine in a case where the specific condition is not satisfied.

2. The wheel loader according to claim 1, wherein the motion sensor is an operation amount sensor that detects a lifting operation amount of the lift arm, and the controller reduces the maximum rotational speed of the engine with an increase in the lifting operation amount of the lift arm.

3. The wheel loader according to claim 1, wherein the motion sensor is a pressure sensor that detects a discharge pressure of a hydraulic pump that supplies the front working device with hydraulic oil, and the controller reduces the maximum rotational speed of the engine with an increase in the discharge pressure or an input torque of the hydraulic pump pertaining to the lifting operation of the lift arm.

4. The wheel loader according to claim 1, wherein the controller reduces the maximum rotational speed of the engine more than the maximum rotational speed of the engine in a case where the specific condition is not satisfied only until the lift arm is completely lifted from a horizontal attitude in the upper direction.

5. The wheel loader according to claim 1, wherein only in a case of a low speed stage selected for travel toward a dump truck in a loading operation, the controller reduces the maximum rotational speed of the engine more than the maximum rotational speed of the engine in the case where the specific condition is not satisfied.

6. The wheel loader according to claim 1, wherein the controller stores a change rate of the maximum rotational speed of the engine with respect to the state of the lifting motion of the lift arm, and reduces the maximum rotational speed of the engine according to the change rate.

* * * * *